US005743309A

United States Patent [19]

Slater Christensen

[11] Patent Number: 5,743,309

[45] Date of Patent: Apr. 28, 1998

[54] JOINING TOOL AND A METHOD FOR ITS USE

[76] Inventor: Rolf James Slater Christensen, Mølagervej 23, DK-8382, Hinnerup, Denmark

[21] Appl. No.: 718,395

[22] PCT Filed: Apr. 20, 1995

[86] PCT No.: PCT/DK95/00165

§ 371 Date: Oct. 1, 1996

§ 102(e) Date: Oct. 1, 1996

[87] PCT Pub. No.: WO95/29021

PCT Pub. Date: Nov. 2, 1995

[30] Foreign Application Priority Data

Apr. 20, 1994 [DK] Denmark ..... 0454/94

[51] Int. Cl.[6] ..... B21F 09/02

[52] U.S. Cl. ..... 140/119; 140/57

[58] Field of Search ..... 140/57, 119

[56] References Cited

U.S. PATENT DOCUMENTS 4,252,157 2/1981 Ohnishi .

4,362,192 12/1982 Furlong et al. .

4,508,030 4/1985 Grenon ..... 140/119

4,655,264 4/1987 Dilley .

*Primary Examiner*—Lowell A. Larson

*Attorney, Agent, or Firm*—Watson Cole Stevens Davis, P.L.L.C.

[57] ABSTRACT

A joining tool for automatically joining or intertwining two or more items, preferably reinforcement rods (23). The joining tool advances a joining wire (6) in a not predetermined length through a track (5) in a ring-shaped head (2). The advancing movement of the joining wire (6) stops when the wire has completed the turn and the wire is then held at its free end by a holding pin (10) whereupon it is pulled back until it is tight around the reinforcement rods (23). Upon tightening the joining wire (6) is held by another holding pin (12) whereupon two cutting sleeves (14 and 15) cut the joining wire (6). After cutting, a turning head (7) is rotated until the desired joining strength is obtained. The desired joining strength is determined by a U-shaped brace (19). When the desired joining strength has been obtained, the joining wire is released by the holding pins (10 and 12).

8 Claims, 5 Drawing Sheets

JOINING TOOL AND A METHOD FOR ITS USE

BACKGROUND OF THE INVENTION

The present invention relates to a method for automatically binding or joining two or more reinforcement bars with the use of a joining tool that includes a two-section annular body, the method including a first step wherein an endless binding wire with a free end is fed to a track in the annular body, the binding wire being fed to a length determined by the tool structure, a second step wherein the free end of the wire is retained, a third step wherein the retained binding wire is cut, a fourth step wherein a rotation head ties the wire around the reinforcement bars.

The invention also relates to a joining tool for use by the method, the joining tool consisting of a housing in which a channel is formed for guiding an endless binding wire from a supply to a rotation head connected with a shaft that rotates around an axis of rotation, the rotation head being mounted in the upper part of the housing, a two-section annular body being also mounted at the upper part of the housing, the annular body being connected pivotally to the housing by at least one shaft, the annular body including of a first section and second section both of which are provided with a lateral open track, the track being open towards the centre of the annular body, the joining tool being provided with retention members for retaining the binding wire and cutting members for cutting the binding wire.

THE PRIOR ART

It has been known to join reinforcement bars of concrete structures manually. However, this is a lengthy operation and, therefore, associated with high salary expenses. Furthermore, the working postures used during the joining operation are not always sound and, consequently, may be injurious to a person who is frequently joining reinforcement bars.

An attempt to solve this problem was made in U.S. Pat. No. 4,362,192 which describes a joining tool for joining reinforcement bars in concrete elements. The joining tool functions by advancing a predetermined length of endless binding wire inside the joining tool to a track in an annular head. When the wire has been brought all around the annular head, the wire is retained and cut by means of a cutting member and a disc being pressed against each other. After cutting, the two now free ends are twisted until the desired binding has been provided.

A joining tool of the known type has the disadvantage, however, that the binding cannot be done without leaving a considerable amount of binding wire remnants which will remain in the surface of the concrete in the finished structure, thus causing the strength of the concrete to be deteriorated or causing the concrete to be discoloured due to corrosion of the binding wire remnants. This means that after the binding of a structure of reinforcement bars, it is necessary to do a collection of wire remnants.

A joining tool of this type further has the disadvantage that the advancement of the wire takes place in a predetermined length, which means considerable waste of binding wire in the form of the mentioned binding wire remnants, particularly when the tool is used for joining reinforcement bars having great variation in thickness and numbers since the length of the binding will consequently vary considerably.

Furthermore, a joining tool of this type is disadvantageous in that it has no automatic regulation of the tightening of the binding, which may cause the strength of the joined reinforcement bars to be very heterogeneous.

From EP-B-388,350 it is known to feed the binding wire in a not predetermined length in a tool structure which grips the reinforcement bars. The movement of the wire is stopped as the wire encounters a flexible axis which activates a contact by which the movement of the wire is stopped. Thereafter the wire is held at its free end and the joining tool is opened, and the reinforcement bars are pushed forward by a holder to contact the binding wire. The binding wire is then cut at its not free end. Finally, the inside of the holder rotates and the wire is twisted around the reinforcement bars.

However, a joining tool of this type has the disadvantage that a homogeneous quality of the joining of the reinforcement bars is not always ensured. Thus, it is not possible to give the joining of reinforcement bars a predetermined quality (strength) as the wire is only held at one of its ends. A joining tool of the type described above has the further disadvantage that the process is relatively time-consuming since the holder with the reinforcement bars must be pushed forward at the same time as the joining tool is partially opened in order to contact the binding wire. This is an extra and time-consuming work process.

A method mentioned in first paragraph of this specification is known from U.S. Pat. No. 4,252,157. However, according to this patent the free ends of the wire are bent in order to retain said ends during an initial twisting. This retaining of the free ends would allow for different tightening of the wire.

SUMMARY OF THE INVENTION

It is the object of the present invention to disclose a method which remedies the above-mentioned disadvantages, and to provide an apparatus for use by the method. The invention thus discloses a method and an apparatus which will

- not leave binding wire remnants,
- feed the wire in a length determined by the tool structure but, however, in a length that is not predetermined (determined by need), depending on the need (the bar thicknesses),
- ensure that the joining is always made with a homogeneous quality, and
- ensure equal tightening of the wire irrespective of the reinforcement bar thickness.

This object is obtained by a method which is characterized in that only the free end of the binding wire is retained, and that this takes place in the rotation head, that the binding wire is pulled back in order to become tight around the reinforcement bars, that the rotation head is briefly reverted at suitable intervals during the tying step, that having been pulled back and immediately before being cut, the binding wire is retained at a point in immediate vicinity of a cutting point, and that the retained binding wire is only released after the binding wire has been tied around the reinforcement bars.

The object is also obtained by an apparatus for use by the method, which is characterized in that the free end of the binding wire is retained by a first retention pin, that pulling back the wire is performed after the first retention pin has retained the binding wire at its free end, that the binding wire is retained by a second retention pin at the cutting point.

With a method and an apparatus according to the present invention it is possible to make the joining of the reinforcement bars without leaving any binding wire remnants. This is obtained by retaining the binding wire in its free end and only cutting it at the end to become free.

It is further possible with the present invention to do the joining of the reinforcement bars with optimal use of the binding wire and to cut down on the working time associated with joining. This is due to the fact that with every joining the binding wire is pulled back after the free end has been retained so that the binding wire is tightened loosely around the reinforcement bars. Moreover, due to the fact that the rotation head is briefly reverted at suitable intervals an optimal positioning of the joining is obtained. In this manner it is ensured that each joining of a structure is made with the same binding strength irrespective of the amount or the dimensions of the reinforcement bars to be joined and that the binding strength is obtained at the smallest circumference. In this manner the homogeneous quality of the structure is obtained. Moreover, this means that only the necessary amount of binding wire is used in every joining and that the time consumption of each binding is largely constant and reduced to a minimum.

With the present invention it is further possible to provide optimal tightening of each joining when the joining tool according to an advantageous embodiment is provided with a U-shaped brace, which is activated when the binding obtains a predetermined strength. By adjusting an elastic force between the U-shaped brace and a switch, the binding force is varied. This is particularly useful when using binding wire and/or reinforcement bars of different dimensions.

Furthermore, with a joining tool according to the present invention an apparatus is provided the structure of which is simple and in which the wearing parts are separate parts. In this manner one obtains an apparatus with low costs of service and maintenance, as well as easy replacement of parts such as the rotation head and/or the annular body in order to adapt the apparatus to different tasks.

In addition, a joining tool according to the present invention is easy to carry and to use. From the point of view of working environment, therefore, this joining tool is to be preferred over both manual joining and joining with known joining tools.

A method and an apparatus according to the present invention may also be used in fields where frequent and reliable binding or joining of objects or things is required, e.g. packing in bags—where there are special requirements for the closure.

BRIEF DESCRIPTION OF THE DRAWINGS

The invention will be explained in detail below with reference to the accompanying drawing, in which.

DETAILED DESCRIPTION OF THE PREFERRED EMBODIMENT

Figure 1:
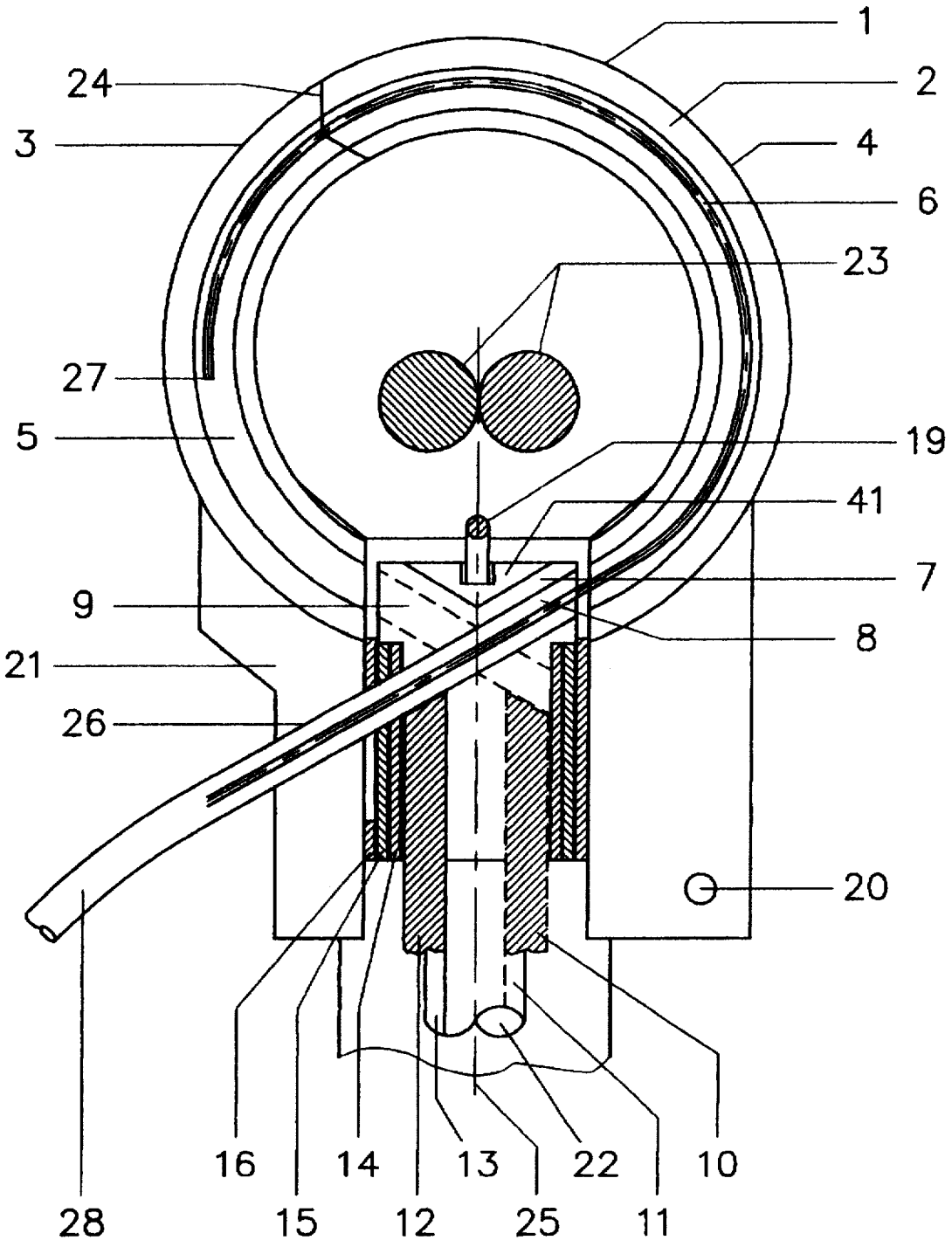
FIG. 1 shows a longitudinal section through a joining tool according to the present invention.

FIG. 1 shows a longitudinal section through a joining tool 1 for joining reinforcement bars 23. The joining tool 1 includes a housing 21 and a two-section annular body 2 at its top. At its bottom the annular body 2 is secured to the top of the housing 21. The annular body 2 consists of a first section 3 and a second section 4. The second section 4 of the embodiment shown is secured to the housing 21 by means of a pivot 20, but the first section 3 might also be secured to the housing 21 in a similar manner by a pivot. In their closed condition the first section 3 and the second section 4 contact each other in a V-shaped groove 24. The joining tool 1 assumes its closed condition as the joining of the reinforcement bars 23 is performed.

Both the first section 3 and the second section 4 are provided with a track 5. The track 5 is designed to receive a binding wire 6 with a free front end 27. In the housing 21, at the bottom of the annular body 2, a rotation head with a downward oriented cone-shaped cut 41 is mounted, the rotation head 7 rotating around an axis of rotation 25. The rotation head 7 being capable of is mounted centrally in the top of the housing 21 of the joining tool 1. In the rotation head 7 a first angled recess 8 and a second angled recess 9 are formed. The angled recesses 8 and 9 are displaced in relation to the axis of rotation 25 and angled in relation to a plane perpendicular to the axis of rotation 25. It is noted that these recesses 8 and 9 are partially open in an upward direction and that this opening extends substantially to the axis of rotation 25.

On the rotation head 7, along its outer periphery, a third inwardly oriented radial recess 11 is formed. The recess 11 is designed to receive a first retention pin 10, which is able to be displaced axially inside it. The recess 11 and the retention pin 10 are designed in such a manner that when the retention pin 10 is at the bottom, it blocks the opening of the angled recess 9. On the rotation head 7 opposite the recess 11 a fourth inwardly oriented radial recess 13 is formed in axial direction. This fourth recess 13 is designed to receive a second retention pin 12 which is able to be axially displaced therein. The recess 13 and retention pin 12, in a manner similar to the recess 11 and the retention pin 10, are designed so that, when at the bottom, the retention pin 12 blocks the opening of the second angled recess 8.

Along its outer periphery the rotation head 7 contacts a first cutting sleeve 14, which in turn contacts a second cutting sleeve 15, which in turn contacts a pusher 16 contacting the inside of the housing 21. The first cutting sleeve 14 is provided with a cutting hole 33 (see FIG. 2), and the second cutting sleeve 15 is similarly provided with a hole 35 (see FIG. 2). Both of these holes 33 and 35 are provided inside with a cutting edge in order to facilitate the cutting of the binding wire 6.

Figure 3:
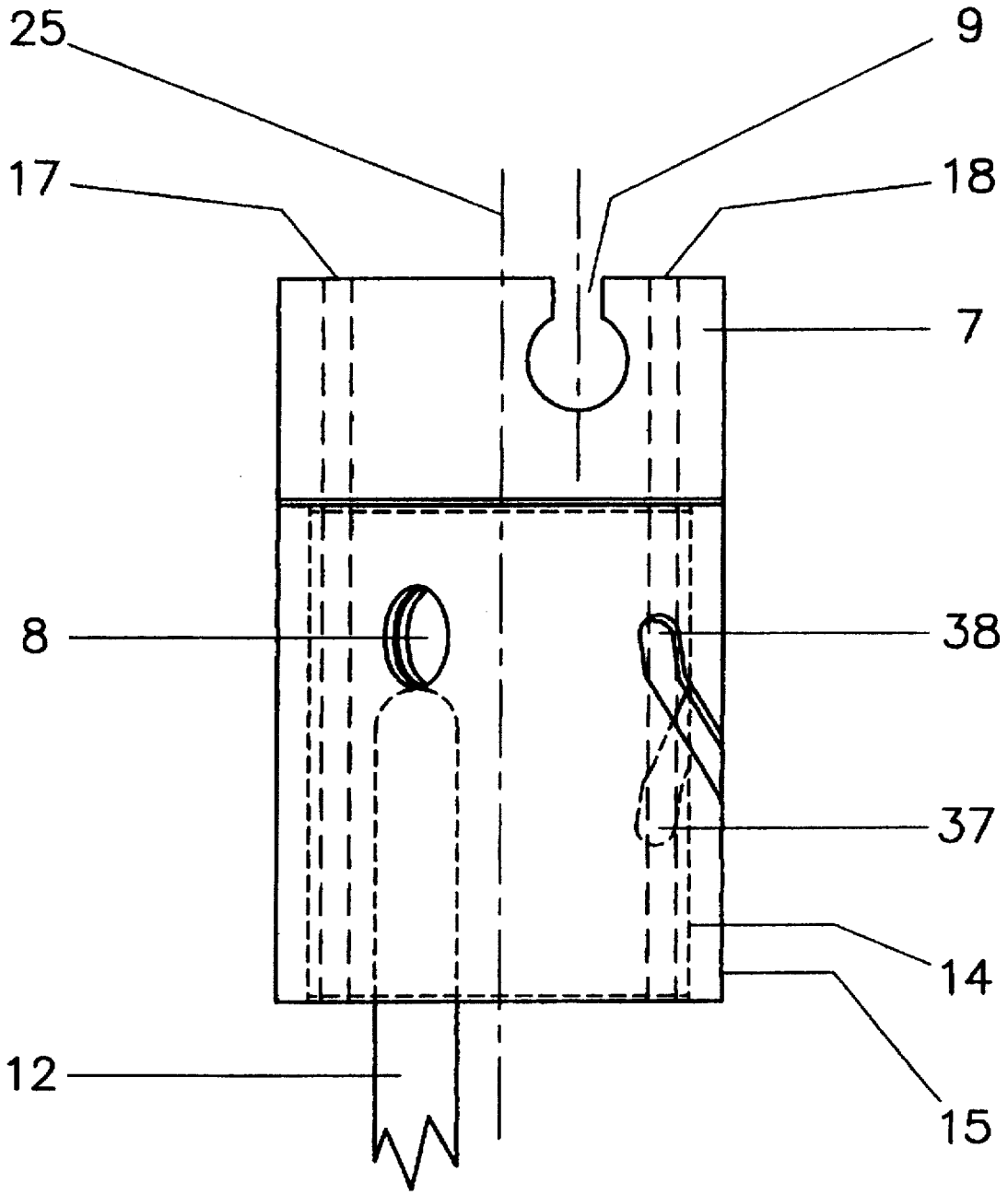
FIG. 3 shows a rotation head which has been turned 90° compared to the one shown in FIG. 2.

Parallel with the axis of rotation 25, two tracks 17, 18 are formed in the rotation head 7 (see FIG. 3). The function of the tracks 17, 18 is to receive a U-shaped brace 19. The rotation head 7 is secured to a shaft 22. The shaft 22 is connected with a motor or similar device giving the rotation head 7 its rotation movement around the axis of rotation 25.

Figure 2:
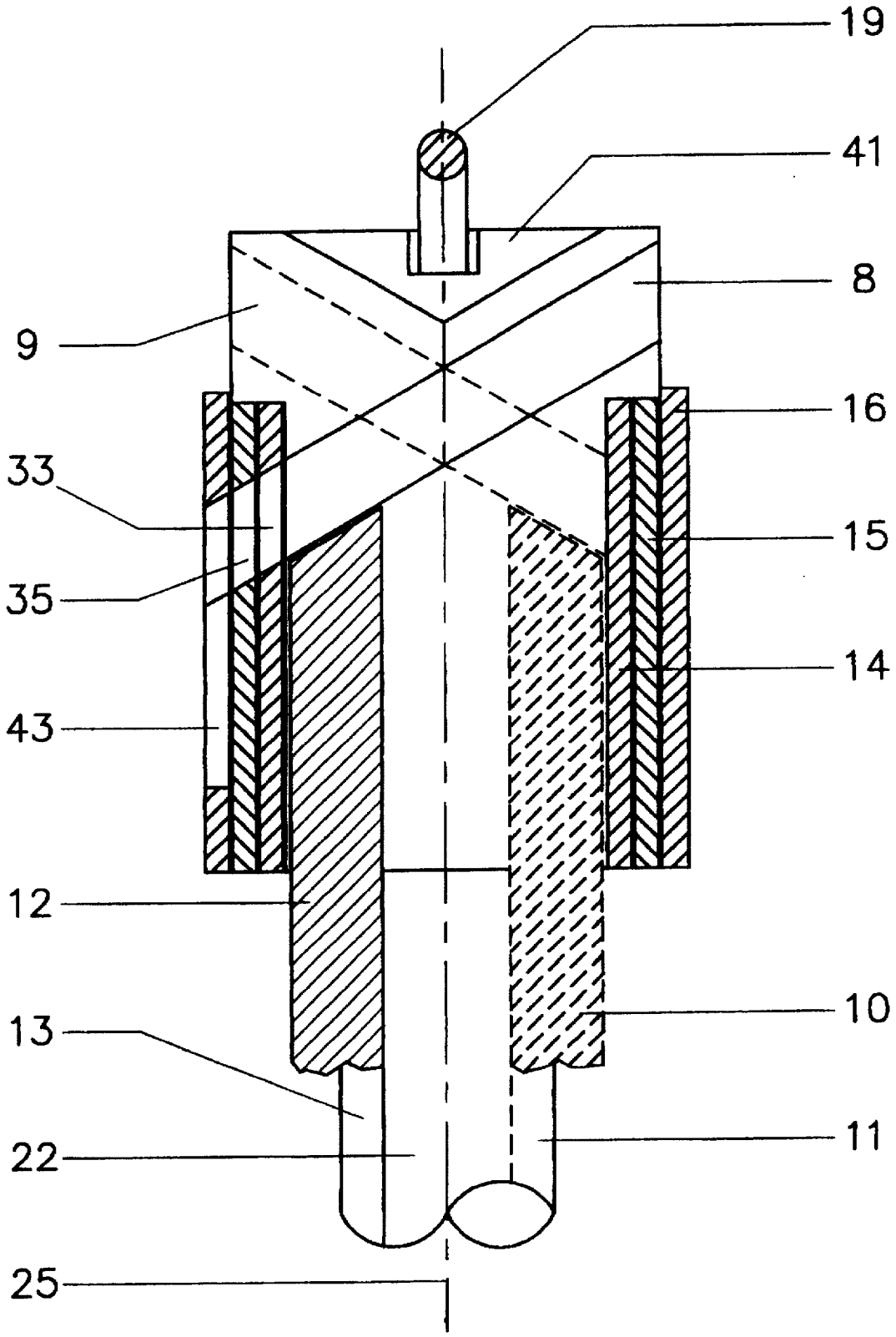
FIG. 2 shows a longitudinal section through a rotation head of a joining tool according to the present invention.

FIG. 2 shows a longitudinal section through the rotation head 7 shown in FIG. 1 with the parts belonging to it. The individual parts are shown in more detail compared to the illustration of FIG. 1. It appears more clearly from this figure that the first angled recess 8 is in front of the second angled recess 9, and that they are consequently displaced in relation to the axis of rotation 25. As can be seen, the ends of the retention pins 10 and 12 have been cut obliquely in order to fit with the slope of the angled recesses 8 and 9. The third and fourth recesses 11 and 13 as well as the tops of the retention pins 10 and 12 have been designed in such a manner that when the retention pins are at the bottom, they are in plane contact with the upper part of the first and second recesses 8 and 9. In this manner it is ensured that the retention pins 10 and 12 will retain the binding wire 6 better and more securely.

As can be seen from the figure, the downward oriented cone-shaped cut 41 is designed so that it has substantially the same angle as the two angled recesses 8 and 9. This is not necessity but it will often be the case since this ensures equal material thickness between the cone-shaped cut 41 and the recesses 8 and 9; this makes it easier for the pusher 16 to advance the binding wire 6 without its being stuck, squeezed or the like in the rotation head 7. The pusher 16 is provided with a hole 43; the length of the hole 43 must at least correspond to the travel of the pusher 16 in order to prevent the newly free end 27 of the binding wire from being damaged (bent). If the cut is made after the binding wire 6 has been advanced by the pusher 16, this is more obvious. Also seen are a hole 33 in the first cutting sleeve 14 and a hole 35 in the second cutting sleeve 15; these holes will normally be provided with a cutting edge.

In FIG. 3 a rotation head 7 is seen which has been turned 90° around the axis of rotation 25 compared to what is shown in FIG. 2, but without pusher 16 and U-shaped brace 19. The figure shows the top of the second angled recess 9 and the bottom of the first angled recess 8; immediately under the latter the first retention pin 12 is shown. As can be seen, the rotation head 7 is provided with the two cutting sleeves 14 and 15. The first cutting sleeve is provided with a track 37, and the second cutting sleeve is provided with a track 38. These tracks 37 and 38 are largely identical, but inverted in relation to each other. The tracks 37 and 38 are designed to receive (see FIG. 4) a projection 32 of a cam follower 29. The follower 29 is also provided with a head 31.

Figure 4:
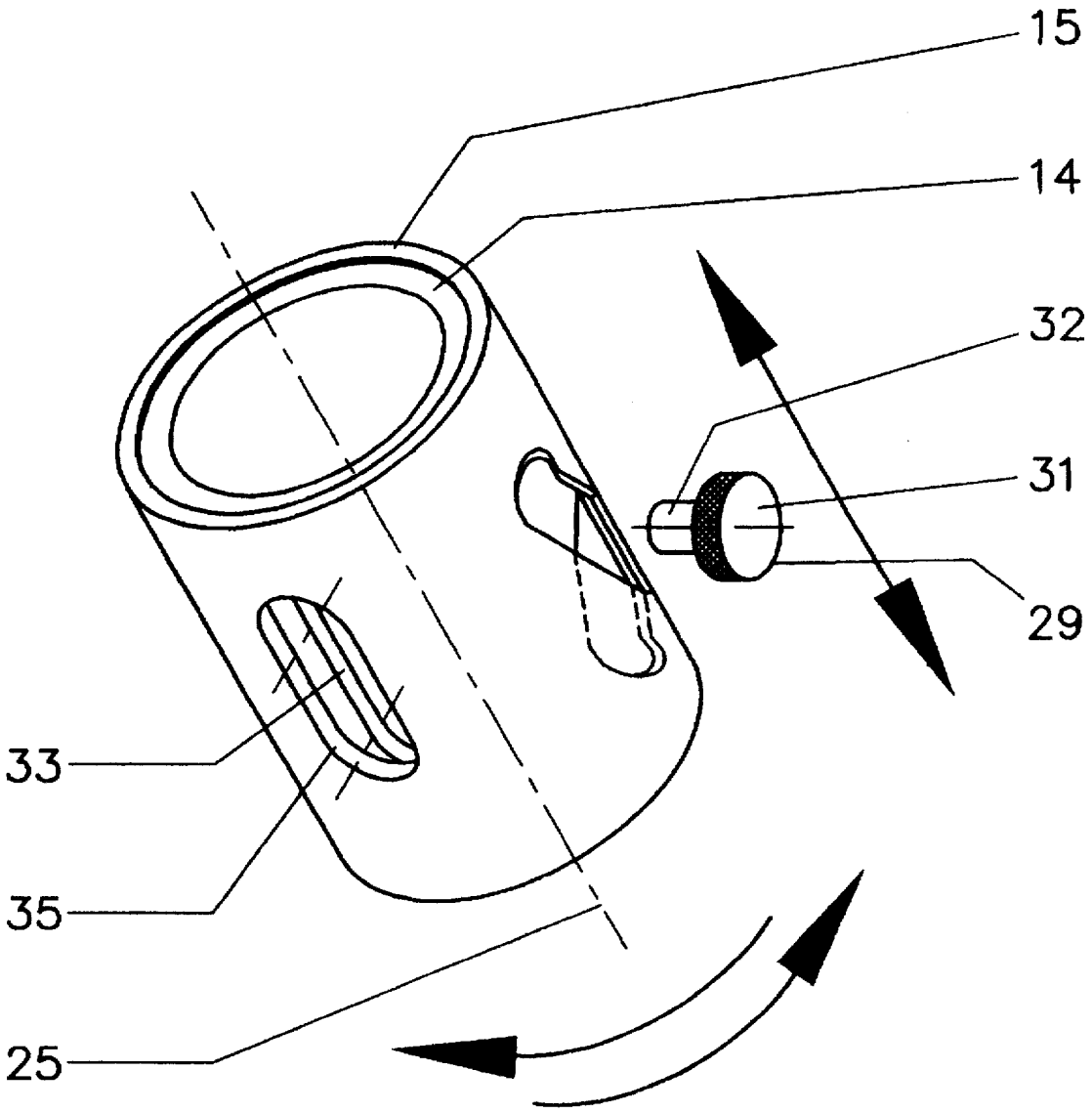
FIG. 4 shows a perspective view of the two cutting sleeves and the cam follower.

The first cutting sleeve 14 and the second cutting sleeve 15 with the follower 29 are seen in a perspective view in FIG. 4. It is indicated in the figure how the two cutting sleeves 14 and 15 are displaced in opposite directions around the axis of rotation 25 as the follower 29 with the projection 32 is displaced back or forth. In one extreme position the holes 33 and 35 will be placed adjacent each other (as shown in FIGS. 1 and 2), whereas in the other extreme position they will not overlap. This provides for the cutting of the binding wire 6.

Figure 5:
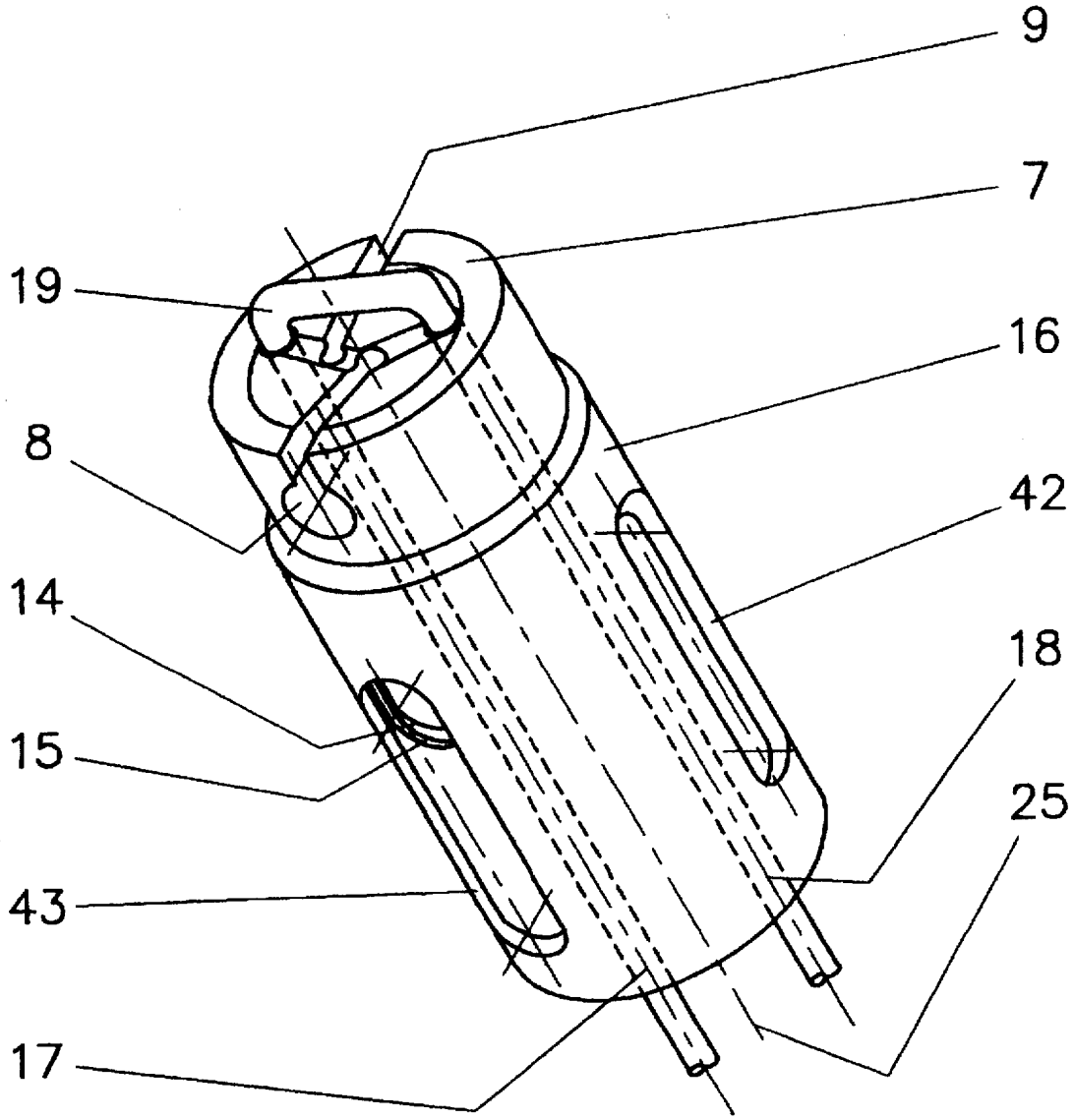
FIG. 5 shows a perspective view of a rotation head having a U-shaped brace with two cutting sleeves and a pusher.

FIG. 5 shows a perspective view of a rotation head 7 with the U-shaped brace 19, the first cutting sleeve 14, the second cutting sleeve 15 and the pusher 16. As appears from the figure, the pusher 16 is provided with a second hole 42 in addition to its first hole 43. The second hole 42 is used for the passage of the projection 32 of the follower 29. The length of this hole 42 depends on the travel of the pusher 16 in relation to the follower 29, in the same way as the length of the hole 43 depends on the travel of the pusher 16.

The figure shows each of the angled recesses 8 and 9 with their openings towards the cone-shaped cut 41 and how these openings extend largely to the centre of the rotation head 7.

The joining tool 1 according to the invention is used by placing the annular body 2 around the reinforcement bars 23 to be joined. The binding wire 6 comes from a spool (not shown) and is fed through a cable 28 by means of a feeding mechanism (not shown). The feeding mechanism may be positioned both in the joining tool 1 and in an external unit (not shown) in which, for example, the spool with the binding wire 6 is also kept. The cable 28 is mounted on the housing 21 where it is positioned in immediate extension of the canal 26.

The wire is fed in a not predetermined length through the cable 28 and the canal 26, to the first recess 8, then through the track 5 of the annular body 2 and around to the second recess 9. When the wire has been pushed all the way in the annular body 2 in this manner, the first retention pin 10 is displaced axially up into the third recess 11, where it retains the wire 6 at its free end 27.

Next the binding wire 6 is pulled back by reversing the feeding mechanism. The pulling is stopped when a predetermined, desired traction force occurs in the wire 6. When the pulling has ended, the second retention pin is displaced axially up into the fourth fourth recess 13 thereby retaining the binding wire 6 at the cutting point.

The head 31 of the follower 29 is then displaced axially forward in the housing 21, and the projection 32 thereby forces the innermost cutting sleeve 14 and the outermost cutting sleeve 15 to rotate in opposite directions (see FIG. 5). Due to this opposite rotation, the binding wire 6 is cut between the cutting edge of the innermost cutting hole 33 and the cutting edge of the outermost cutting hole 35.

After cutting the binding wire 6, the pusher 16 is displaced forward in order to ensure that the wire 6 is pushed free of the track 5 at the recesses 8 and 9. This is necessary before starting the twisting as the binding wire 6 would otherwise be stuck in the track 5 and might be cut when the rotation head 7 is rotated.

It should be noted that displacement of the pusher 16 and cutting of the binding wire 6 by the cutting sleeves 14 and 15 may be executed in the opposite order of the one indicated above.

After the movement of the pusher 16, the rotation of the rotation head 7 is commenced. The rotation head 7 is primarily rotated in one direction, but at suitable intervals it is briefly turned the opposite way in order to ensure that the binding wire is tightened in a plane perpendicular to the reinforcement bars 23, i.e., where they have the least possible circumference. In this manner the best possible retention of the reinforcement bars 23 is obtained.

The rotation of the rotation head 7 ends when the desired binding strength has been obtained. This is ensured by the fact that the joined wire ends will force the U-shaped brace 19 downward. The U-shaped brace 19 will, when it has overcome a predetermined elastic force, activate a switch or the like (not shown) to stop the rotation of the rotation head 7. After the rotation head 7 has stopped rotating, the first retention pin 10 and the second retention pin 12 will be pulled back from their respective recesses 11 and 13, thus releasing the retention of the binding wire 6.

The feeding of the binding wire 6 in a not predetermined length and the pulling back of the binding wire 6 so that, for example, it is tight/in contact with the reinforcement bars 23, may be accomplished in many ways. For example, one may have a resistance gauge in the feeding mechanism measuring both the compressive and the traction forces in the wire in order to indicate when the feeding mechanism is to stop feeding or pulling back the binding wire 6.

A different way of ensuring that the binding wire is fed all the way past the retention pin 10 may be obtained by placing a switch in the bottom of the recess 9. This switch will take care of stopping the feeding of the binding wire 6.

I claim:

1. A method for automatically joining at least two reinforcement bars using a joining tool that includes a two-section annular body and a rotation head, said annular body defining a radially inwardly-open track along which a binding wire can be pushed so as to surround the reinforcement bars to be joined and to pass into the rotation head, the method comprising the steps of:

(a) positioning the annular body around the reinforcement bars to be joined, (b) passing a binding wire in a forward direction along said track in the annular body so as to surround the reinforcement bars to be joined and so that a free end of the binding wire enters the rotation head, (c) fixedly clamping the free end of the binding wire in the rotation head, (d) pulling the binding wire in a backward direction so that the binding wire moves inwardly out of said track and tightly around the reinforcement bars to be joined, (e) clamping the binding wire at a point remote from the free end so that the binding wire remains tightly wrapped around the reinforcement bars to be joined, (f) cutting the binding wire adjacent said clamping point, (g) rotating said rotation head so that ends of said binding wire are twisted together to fixedly wrap said binding wire around said reinforcement wires to be joined, said rotation including rotation in a first direction with brief intermittent rotations in a reverse, second direction, and releasing said binding wire from said rotation head.

2. A method according to claim 1, wherein in step (b) said binding wire is passed through said rotation head before entering said track and wherein in step (e) said binding wire is clamped by moving a retention pin within said rotation head.

3. A joining tool (1) for use in automatically joining two or more reinforcement bars consisting of a housing (21) containing a channel (26) for guiding an endless binding wire (6) from a supply to a rotation head (7) connected with a shaft (22) that rotates around an axis of rotation (25), said rotation head (7) being mounted in an upper part of the housing (21), a two-section annular body (2) located at an upper part of the housing (21), said annular body (2) being pivotally connected to the housing (21) by at least one shaft (20), said annular body (2) consisting of a first section (3) and a second section (4) which each contain a lateral open track (5), said track (5) being open towards a centre of the annular body (2), said joining tool including with retention members (10, 12) for retaining the binding wire (6) and cutting members (14, 15) for cutting the binding wire (6), said rotation head (7) including first and second recesses (8, 9) which are angled in relation to a plane extending perpendicularly to an axis of rotation (25) of the rotation head, the first and second recesses (8 and 9) extending substantially transversely through the rotation head (7) as they extend in two parallel planes which are parallel with but slightly displaced in relation to the axis of rotation (25), and wherein parallel with the axis of rotation (25), in the same plane as the first angled recess (8) and the second angled recess (9), a third recess (11) for receiving a retention pin (10) and a fourth recess (13) for receiving a second retention pin (12) are formed, and that on the rotation head (7), outwardly in radial direction, inner and outer mutually rotatable cutting sleeves (14 and 15) are mounted.

4. A joining tool (1) according to claim 3, wherein the rotation head (7) includes a fifth recess (17) and a sixth recess (18) for receiving a U-shaped brace (19), said fifth and sixth recesses extending in parallel with the axis of rotation (25) and in a plane substantially perpendicular to the two planes of the third recess (11) and the fourth recess (13) as well as the first angled recess (8) and the second angled recess (9).

5. A joining tool (1) according to claim 3, wherein a pusher sleeve (16) is located around the outer cutting sleeve (15), said pusher sleeve including an outer side which is in contact with an inner side of the housing (21).

6. A joining tool (1) according to claim 3, wherein a downward cone-shaped bore (41) having a vertex on the axis of rotation (25) is located towards the first angled recess (8) and the second angled recess (9) in the rotation head (7).

7. A joining tool (1) according to claim 3, wherein the shaft (22) is rotatable in both directions, and the shaft (22) is fixedly mounted on the rotation head (7).

8. A joining tool (1) according to claim 3, wherein the shaft (22) is directly connected with a driving motor.

* * * * *